US006708763B2

(12) United States Patent
Howard et al.

(10) Patent No.: US 6,708,763 B2
(45) Date of Patent: Mar. 23, 2004

(54) METHOD AND APPARATUS FOR INJECTING STEAM INTO A GEOLOGICAL FORMATION

(75) Inventors: William F. Howard, West Columbia, TX (US); Jackie C. Sims, Houston, TX (US); Dudley L. Robinson, Houston, TX (US); Ronald W. Schmidt, Richmond, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 48 days.

(21) Appl. No.: 10/097,448

(22) Filed: Mar. 13, 2002

(65) Prior Publication Data

US 2003/0173086 A1 Sep. 18, 2003

(51) Int. Cl.[7] ..... E21B 43/24
(52) U.S. Cl. ..... 166/303; 166/269; 166/222
(58) Field of Search ..... 166/383, 386, 166/269, 222, 169

(56) References Cited

U.S. PATENT DOCUMENTS

| | | | | | |
|---|---|---|---|---|---|
| 2,227,539 | A | * | 1/1941 | Dorton | 166/70 |
| 4,050,515 | A | * | 9/1977 | Hamrick et al. | 166/303 |
| 4,557,329 | A | * | 12/1985 | Savard et al. | 166/261 |
| 4,640,355 | A | | 2/1987 | Hong et al. | 166/269 |
| 4,646,828 | A | | 3/1987 | Schwab, Jr. et al. | 166/117.5 |
| 4,648,455 | A | * | 3/1987 | Luke | 166/303 |
| 4,770,244 | A | | 9/1988 | Webb | 166/117.5 |
| 4,921,044 | A | | 5/1990 | Cooksey | 166/116 |
| 5,018,576 | A | * | 5/1991 | Udell et al. | 166/272.3 |
| RE33,614 | E | | 6/1991 | Schwab, Jr. et al. | 166/303 |
| 5,024,274 | A | | 6/1991 | Schwab, Jr. | 166/303 |
| 5,141,054 | A | | 8/1992 | Alameddine et al. | 166/252 |
| 5,141,055 | A | * | 8/1992 | Chien et al. | 166/272.3 |
| 5,365,795 | A | * | 11/1994 | Brower, Jr. | 73/861.65 |
| 5,464,059 | A | * | 11/1995 | Kristiansen | 166/269 |
| 5,707,214 | A | | 1/1998 | Schmidt | 417/109 |
| 5,743,717 | A | | 4/1998 | Schmidt | 417/109 |
| 5,990,370 | A | * | 11/1999 | Sims | 585/650 |
| 6,318,464 | B1 | * | 11/2001 | Mokrys | 166/252.1 |

OTHER PUBLICATIONS

PCT International Search Report, International Application No. PCT/US 03/07771, dated Jul. 29, 2003.

Suzanne Griston, et al., "Field Test Of Tapered–Bore Chokes For Steam Flow Control", Abstract, SPE #35677, May 22, 1996, pp. 269–283, XP002248011, Introduction, p. 269, col. 2, Figures 1, 2.

* cited by examiner

*Primary Examiner*—David Bagnell
*Assistant Examiner*—Shane Bomar
(74) *Attorney, Agent, or Firm*—Moser, Patterson & Sheridan, L.L.P.

(57) ABSTRACT

The present invention generally provides a method and apparatus for injecting a compressible fluid at a controlled flow rate into a geological formation at multiple zones of interest. In one aspect, the invention provides a tubing string with a pocket and a nozzle at each isolated zone. The nozzle permits a predetermined, controlled flow rate to be maintained at higher annulus to tubing pressure ratios. The nozzle includes a diffuser portion to recover lost steam pressure associated with critical flow as the steam exits the nozzle and enters a formation via perforations in wellbore casing. In another aspect, the invention ensures steam is injected into a formation in a predetermined proportion of water and vapor by providing a plurality of apertures between a tubing wall and a pocket. The apertures provide distribution of steam that maintains a relative mixture of water and vapor. In another aspect of the invention, a single source of steam is provided to multiple, separate wellbores using the nozzle of the invention to provide a controlled flow of steam to each wellbore.

33 Claims, 8 Drawing Sheets

(PRIOR ART)

METHOD AND APPARATUS FOR INJECTING STEAM INTO A GEOLOGICAL FORMATION

BACKGROUND OF THE INVENTION

1. Field of the Invention

The present invention relates to the production of hydrocarbon wells. More particularly the invention relates to the use of pressurized steam to encourage production of hydrocarbons from a wellbore. More particularly still, the invention relates to methods and apparatus to inject steam into a wellbore at a controlled flow rate in order to urge hydrocarbons to another wellbore.

2. Description of the Related Art

Artificial lifting techniques are well known in the production of oil and gas. The hydrocarbon formations accessed by most wellbores do not have adequate natural pressure to cause the hydrocarbons to rise to the surface on their own. Rather, some type of intervention is used to encourage production. In some instances, pumps are used either in the wellbore or at the surface of the well to bring fluids to the surface. In other instances, gas is injected into the wellbore to lighten the weight of fluids and facilitate their movement towards the surface.

In still other instances, a compressible fluid like pressurized steam is injected into an adjacent wellbore to urge the hydrocarbons towards a producing wellbore. This is especially prevalent in a producing field with formations having heavy oil. The steam, through heat and pressure, reduces the viscosity of the oil and urges or "sweeps" it towards another wellbore. In a simple arrangement, an injection well includes a cased wellbore with perforations at an area of the wellbore adjacent a formation or production zone of interest. The production zones are typically separated and isolated from one another by layers of impermeable material. The area of the wellbore above and below the perforations is isolated with packers and steam is injected into the wellbore either by using the casing itself as a conduit or through the use of a separate string of tubulars coaxially disposed in the casing. The steam is generated at the surface of the well and may be used to provide steam to several injection wells at once. If needed, a simple valve monitors the flow of steam into the wellbore. While the forgoing example is adequate for injecting steam into a single zone, there are more typically multiple zones of interest adjacent a wellbore and sometimes it is desirable to inject steam into multiple zones at different depths of the same wellbore. Because each wellbore includes production zones with varying natural pressures and permeabilities, the requirement for the injected steam can vary between zones, creating a problem when the steam is provided from a single source.

One approach to injecting steam into multiple zones is simply to provide perforations at each zone and then inject the steam into the casing. While this technique theoretically exposes each zone to steam, it has practical limitations since most of the steam enters the highest zone in the wellbore (the zone having the least natural pressure or the highest permeability). In another approach, separate conduits are used between the injection source and each zone. This type of arrangement is shown in FIG. 1. FIG. 1 illustrates a wellbore 100 having casing 105 located therein with perforations 110 in the casing adjacent each of three separate zones of interest 115, 120, 125. As is typical with a wellbore, a borehole is first formed in the earth and subsequently lined with casing. An annular area formed between the casing and the borehole is filled with cement (not shown) which is injected at a lower end of the wellbore. Some amount of cement typically remains at the bottom of the wellbore. The upper and intermediate zones are isolated with packers 130 and a lower end of one tubular string 135, 140, 145 terminates within each isolated zone. A steam generator 150 is located at the surface of the well and a simple choke 155 regulates the flow of the steam into each tubular. This method of individual tubulars successfully delivers a quantity of steam to each zone but regulation of the steam to each zone requires a separate choke. Additionally, the apparatus is costly and time consuming to install due to the multiple, separate tubular strings 135, 140, 145.

More recently, a single tubular string has been utilized to carry steam in a single wellbore to multiple zones of interest. In this approach, an annular area between the tubular and the zone is isolated with packers and a nozzle located in the tubing string at each zone delivers steam to that zone. The approach suffers the same problems as other prior art solutions in that the amount of steam entering each zone is difficult to control and some zones, because of their higher natural pressure or lower permeability, may not receive any steam at all. While the regulation of steam is possible when a critical flow of steam is passed through a single nozzle or restriction, these devices are inefficient and a critical flow is not possible if a ratio of pressure in the annulus to pressure in the tubular becomes greater than 0.56. In order to ensure a critical flow of steam through these prior art devices, a source of steam at the surface of the well must be adequate to ensure an annulus/tubing pressure ratio of under 0.56.

Critical flow is defined as flow of a compressible fluid, such as steam, through a nozzle or other restriction such that the velocity at least one location is equal to the sound speed of the fluid at local fluid conditions. Another way to say this is that the Mach number of the fluid is 1.0 at some location. When the condition occurs, the physics of compressible fluids requires that the condition will occur at the throat (smallest restriction) of the nozzle. Once sonic velocity is reached at the throat of the nozzle, the velocity, and therefore the flow rate, of the gas through the nozzle cannot increase regardless of changes in downstream conditions. This yields a perfectly flat flow curve so long as critical flow is maintained.

Another disadvantage of the forgoing arrangements relates to ease of changing components and operating characteristics of the apparatus. Over time, formation pressures and permeability associated with different zones of a well change and the optimal amount (flow rate) and pressure of steam injected into these zones changes as well. Typically, a different choke or nozzle is required to change the characteristics (flow rate and steam quality) of the injected steam. Because the nozzles are an integral part of a tubing string in the conventional arrangements, changing them requires removal of the string, an expensive and time-consuming operation.

Another problem with prior art injection methods involves the distribution of steam components. Typically, steam generated at a well site for injection into hydrocarbon bearing formations is made up of a component of water and a component of vapor. In one example, saturated steam that is composed of 70 percent vapor and 30 percent water by mass is distributed to several steam injection wells. Because the vapor and water have different flow characteristics, it is common for the relative proportions of water and vapor to change as the steam travels down a tubular and through some type of nozzle. For example, it is possible to inadvertently inject mostly vapor into a higher formation while injecting mostly water into lower formations. Because the injection process relies upon an optimum mixture of steam components, changes in the relative proportions of water and vapor prior to entering the formations is a problem that affects the success of the injection job.

There is a need therefore, for an apparatus and method of injecting steam into multiple zones at a controlled flow rate in a single wellbore that is more efficient and effective than prior art arrangements. There is a further need for an injection apparatus with components that can be easily changed. There is a further need for an injection system that is simpler to install and remove. There is yet a further need to provide steam to multiple zones in a wellbore in predetermined proportions of water and vapor. There is yet a further need for a single source of steam provided to multiple, separate wellbores using a controlled flow rate.

SUMMARY OF THE INVENTION

The present invention generally provides a method and apparatus for injecting a compressible fluid at a controlled flow rate into a geological formation at multiple zones of interest. In one aspect, the invention provides a tubing string with a pocket and a nozzle at each isolated zone. The nozzle permits a predetermined, controlled flow rate to be maintained at higher annulus to tubing pressure ratios. The nozzle includes a diffuser portion to recover lost steam pressure associated with critical flow as the steam exits the nozzle and enters a formation via perforations in wellbore casing. In another aspect, the invention ensures steam is injected into a formation in a predetermined proportion of water and vapor by providing a plurality of apertures between a tubing wall and a pocket. The apertures provide distribution of steam that maintains a relative mixture of water and vapor. In another aspect of the invention, a single source of steam is provided to multiple, separate wellbores using the nozzle of the invention to provide a controlled flow of steam to each wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides an apparatus and methods to inject steam into a geological formation from a wellbore.

Figure 1:
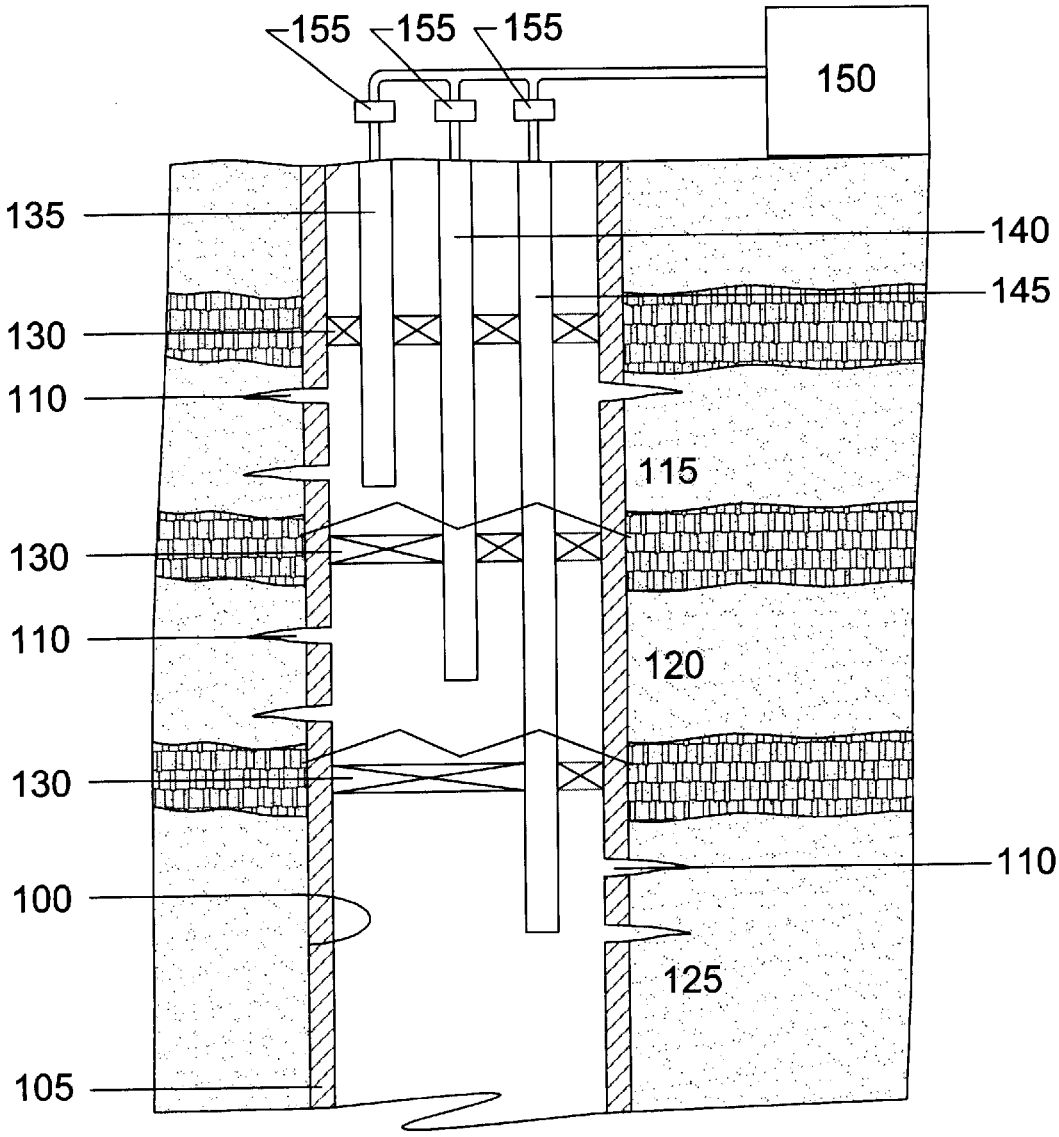
FIG. 1 is a section view of a wellbore having three separate tubular strings disposed therein, each string accessing a separate zone of the wellbore.
Figure 2:
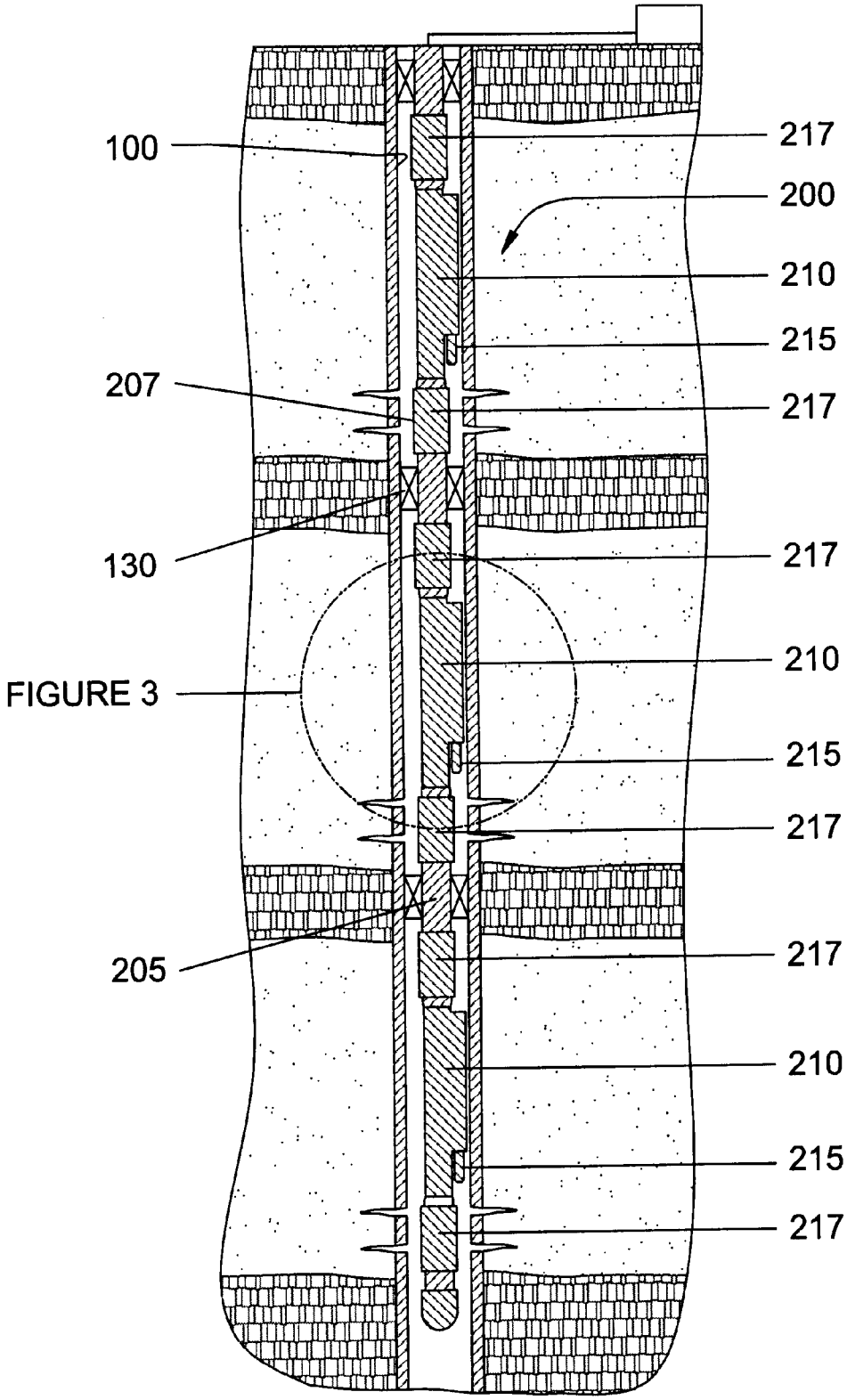
FIG. 2 is a section view of a wellbore illustrating an apparatus of the present invention accessing three separate zones in the wellbore.

FIG. 2 is a section view of a wellbore 100 illustrating an apparatus 200 of the present invention disposed in a wellbore. A string of tubulars 205 is coaxially disposed in the wellbore 100. In the embodiment of FIG. 2, the tubing string includes three enlarged area or pockets 210 formed therein, each of which define an annular area with the casing and include a nozzle 215 at one end. The apparatus is located in a manner whereby the pockets formed in the tubular are adjacent perforated sections of the casing. Each perforated area corresponds to a zone of the well to be injected with steam. Each pocket is preferably formed in a sub that can be located in the tubular string and then positioned adjacent a zone. Each nozzle provides fluid communication between the apparatus and a zone of interest. Each zone is isolated with packers 130 to ensure that steam leaving the pocket via the nozzle travels thorough the adjacent perforations in the casing. Each nozzle is formed with a throat 250 and diffuser portion 245 (FIG. 4) to efficiently utilize the steam as will be described. In use, the apparatus 200 is intended to deliver a source of steam from the surface of the well to each zone and to ensure that each zone receives a predetermined amount of steam, and that amount of steam is determined by the supply pressure at the surface and the characteristics of the nozzle. As shown in FIG. 2, the number of subs depends upon the number of zones to be serviced. The subs are disposed in the tubing string with threaded connectors 217 at each end. The packers 130 are typically cup packers and each may include a pair of cup packers to prevent flow across the packers in either direction.

Figure 3:
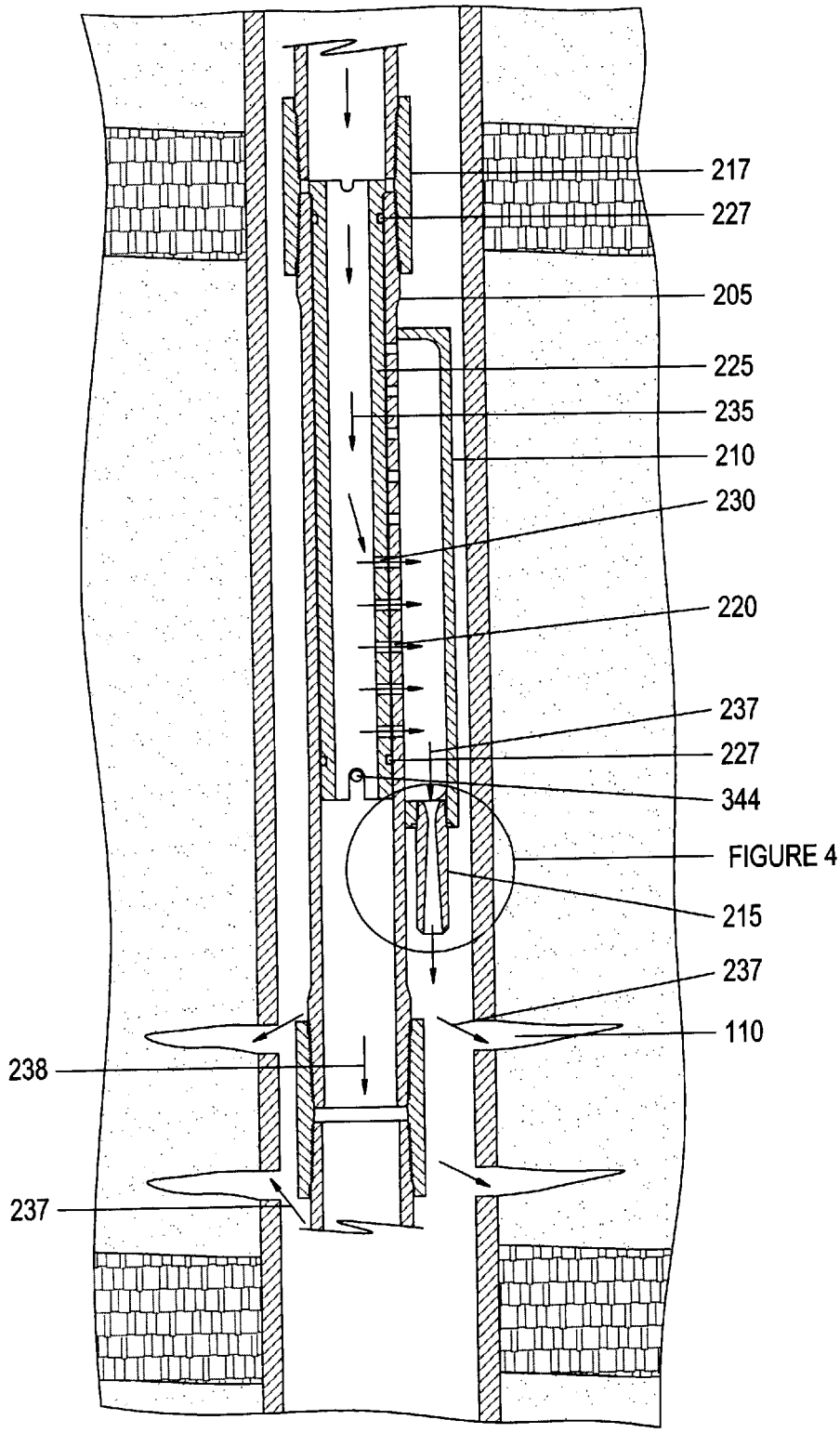
FIG. 3 is an enlarged view of the apparatus of FIG. 2 including a tubular body with apertures in a wall thereof, a pocket formed adjacent the body, and a nozzle having a diffuser portion.

FIG. 3 is an enlarged view of a portion of the tubing 205 and the adjacent pocket 210. Fluid communication between the tubular and the pocket is provided with a plurality of apertures 220 formed in a wall of the tubular adjacent the pocket. Additionally, a sleeve 225 is located in the interior of the tubular to permit selective use of the apertures 220 depending upon the amount of steam needed at the zone. The sleeve 225 is preferably fitted into the tubing at the surface of the well prior to run in. The apertures 230 of the sleeve are constructed and arranged to align with the apertures 220 of the tubing 205. The use of a sleeve having a predetermined number of apertures permits fewer than all of the apertures in the tubing to be utilized as a fluid path between the tubing and the pocket. In this manner, the characteristics of the steam at a particular pocket 210 can be determined by utilizing a sleeve with more or fewer apertures rather than fabricating a tubing for each application. The sleeve 225 is sealed within the tubing with seal rings 227 at each end of the sleeve 225. A slot and pin arrangement 344 between the sleeve 225 and the tubing 205 rotationally aligns the aperture of the sleeve with those of the tubing. The flow of steam from the tubing through the apertures 230 of the sleeve is shown with arrows 235. Steam in the pocket 210 thereafter travels from the nozzle through the perforations as shown by arrows 237. A portion of the steam continues downward as shown by arrow 238 to service another pocket located on the tubular string below.

Figure 4:
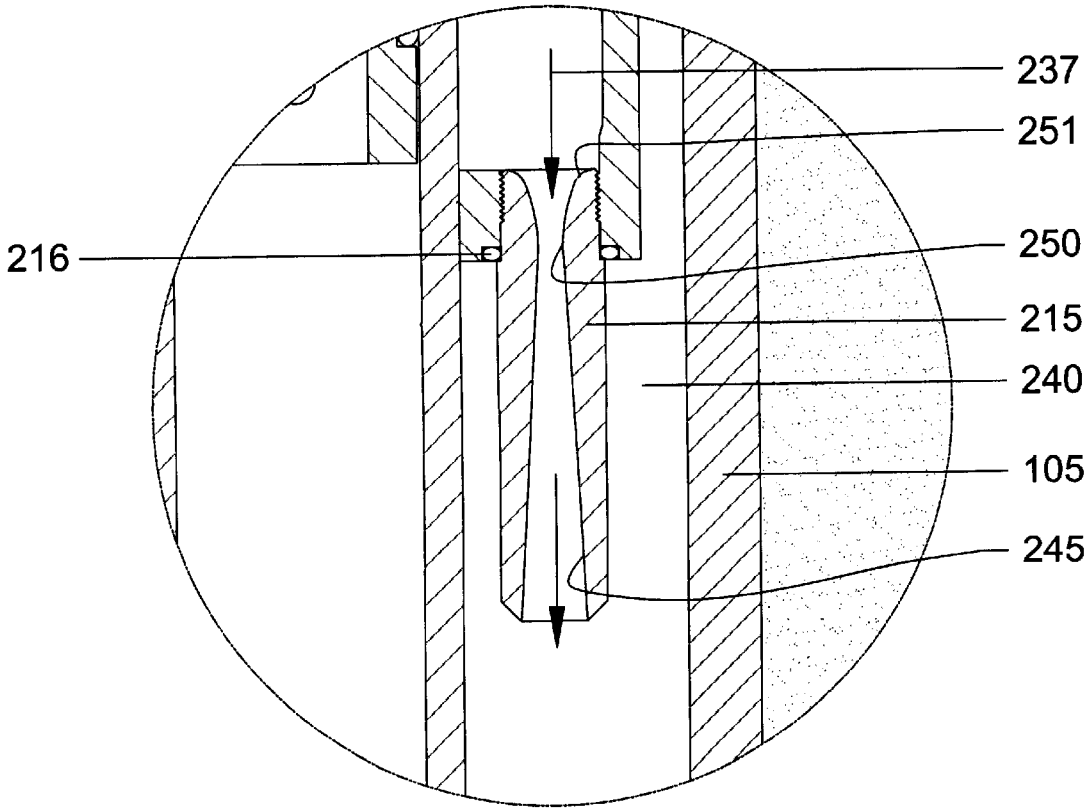
FIG. 4 is an enlarged view of the nozzle of the apparatus showing a throat and the diffuser portion of the nozzle.

FIG. 4 is an enlarged view of the nozzle 215 providing fluid communication between pocket 210 and an annular area 240 defined between the tubing and the wellbore casing and sealed at either end with a packer (not shown). The nozzle 215 is threadingly engaged in the pocket and sealed therein with a seal ring 216. As stated, prior art nozzles used in steam injection typically provide a critical flow of steam at lower annulus/tubing pressure ratios. At higher pressure ratios, they provide only a non-critical restriction to the flow of steam. Unlike prior art nozzles, the nozzle of FIG. 4 includes a diffuser portion 245 as well as a throat portion 250. In use, velocity of the steam increases as the pressure of the steam decreases when the steam passes through a nozzle inlet 251. Thereafter, the diffuser portion, because of the geometry of its design, causes the steam to regain much of its lost pressure. The result is a critical flow rate at a higher annulus/tubing ratio than was possible with prior art nozzles. While nozzles with diffuser portions are known, they have not been successfully utilized to inject steam at a critical flow rate into a geological formation according to the present invention.

Figure 5:
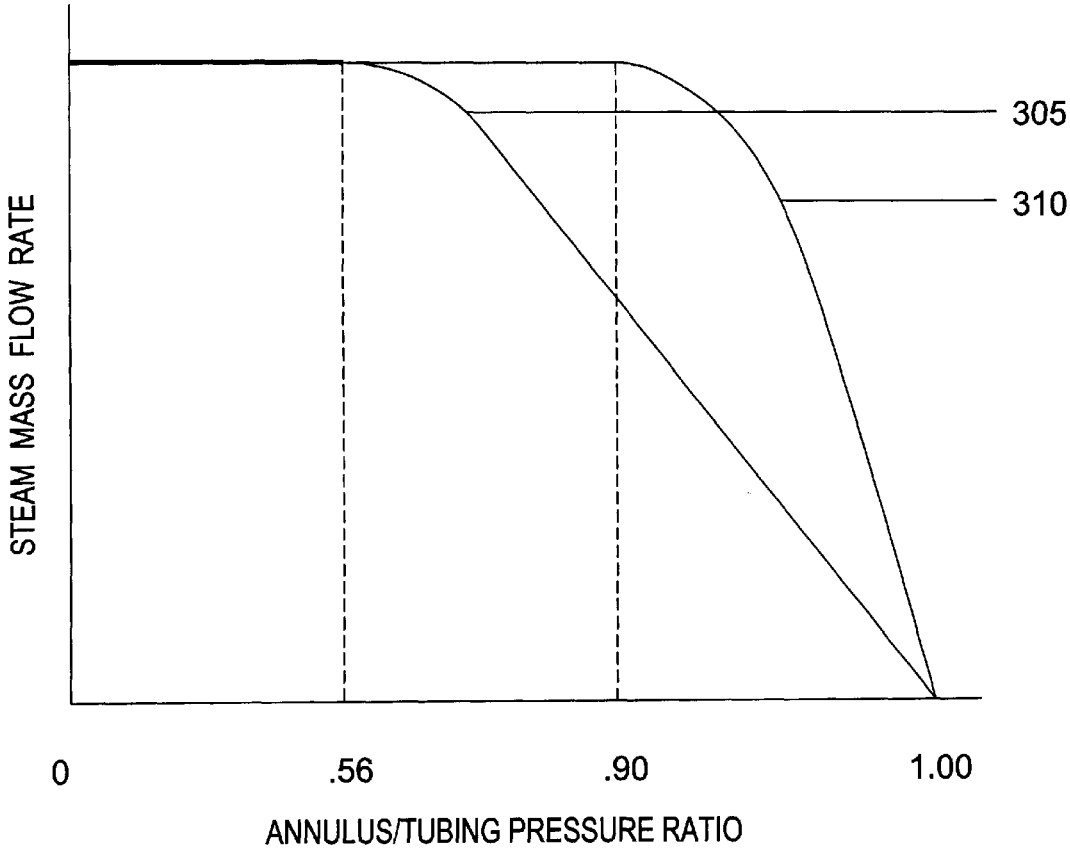
FIG. 5 is a graph illustrating pressure/flow relationships.

FIG. 5 illustrates a comparison of pressure and flow rate between a prior art nozzle (curve 305) and the nozzle of the present invention (curve 310). In a first portion of the graph, the curves 305, 310 are identical as either nozzle will produce a critical flow of steam so long as the annulus/tubing pressure ratio is at or below about 0.56. However, if the annulus/tubing pressure ratio becomes greater than 0.56, the prior art nozzle is unable to provide a critical flow of steam and becomes affected by annulus pressure and permeability characteristics of the formation. Because the nozzle of the present invention is so much more efficient in operation, it can continue to pass a critical flow of steam at higher annulus/tubing pressure ratios. In one embodiment, the nozzle can continue to pass a critical flow of steam even at an annulus/pressure ratio of 0.9. The shape of curve 310 shows that using the nozzle of the present invention, critical flow is maintained so long as the annular pressure does not exceed 0.9 of the tubing pressure.

Figure 6:
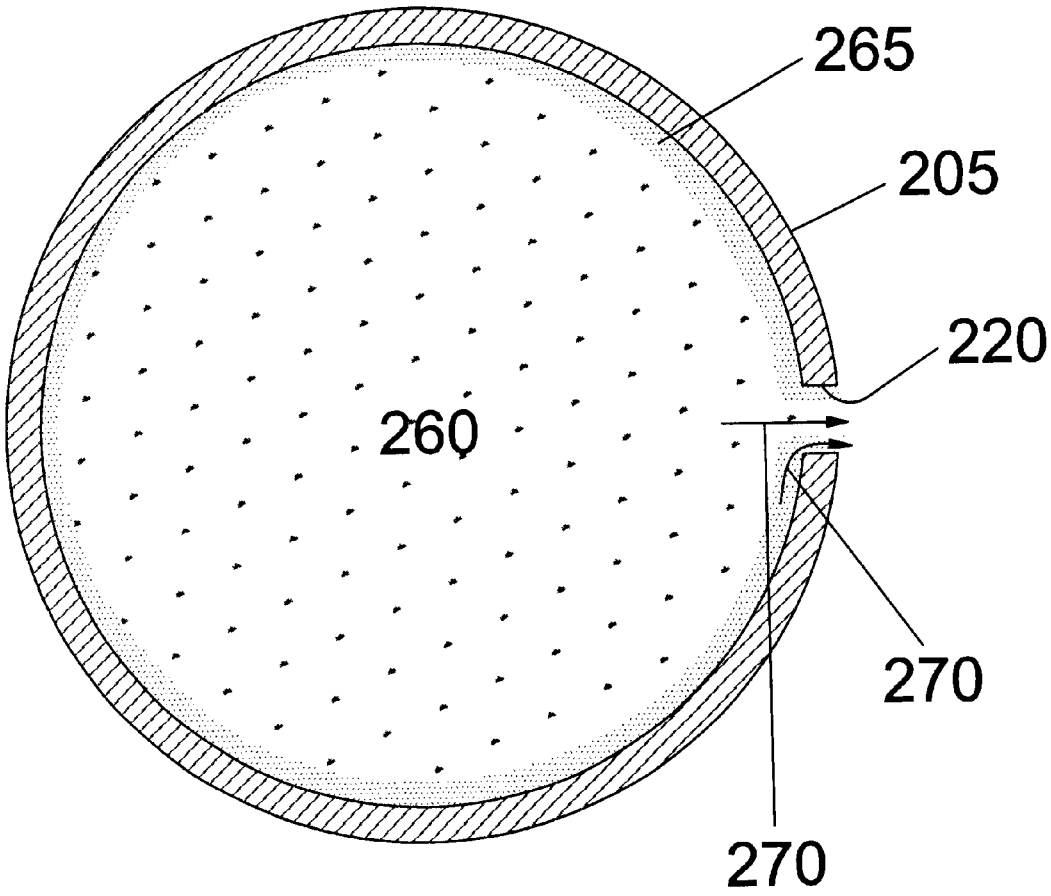
FIG. 6 is a section view of the apparatus illustrating the flow of vapor and water components of steam through the tubular member.

FIG. 6 is a section view showing the interior portion of the tubing 205 adjacent a pocket (not shown) and a single aperture 220 in the tubing 205. For clarity, the sleeve 225 with its aligned apertures 230 is not shown. Illustrated in the Figure is a portion of water 265 and a portion of vapor 260 that includes water droplets. As stated herein, pressurized steam used in an injection operation is typically made of a component of vapor and a component of water. The combination is pressurized and injected into the wellbore at the surface of the well. Thereafter, the steam travels down the tubing string 205 where it is utilized at each zone by a pocket 210 and nozzle 215 as illustrated in FIGS. 2–4.

Returning to FIG. 2, the invention utilizes a plurality of apertures 220 in the tubing 205 and apertures 230 in the sleeve 225 in order to facilitate the passage of steam from the tubing to the pocket 210 in a manner whereby the steam retains its predetermined proportions of vapor and water. At a certain velocity, steam made up of water and vapor will separate with the water collecting and traveling in an annular fashion along the outer wall of the tubular. FIG. 6 illustrates that phenomenon. As shown, vapor and water particles 260 travel in the center of the tubing 205 while the water 265 travels along with inner wall thereof. The path of the water and vapor from the tubing through the apertures is shown with arrows 270. The apertures are sized, numbered and spaced in a way whereby the proportion of water to vapor is retained as the steam passes into the pocket (not shown) and is thereafter injected into the formation around the wellbore. As described herein, the number of apertures utilized for a particular operation can be determined by using a sleeve having a desired number of apertures to align with the apertures of the tubing.

Figure 7A:
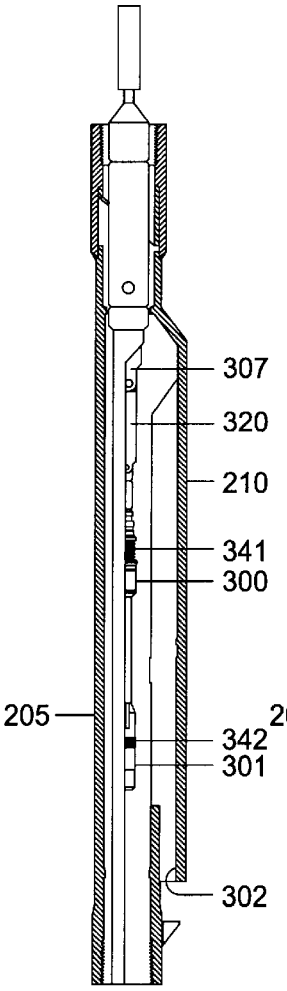
FIGS. 7A–7D are section views showing the insertion of a removable nozzle portion of the invention
Figure 7B:
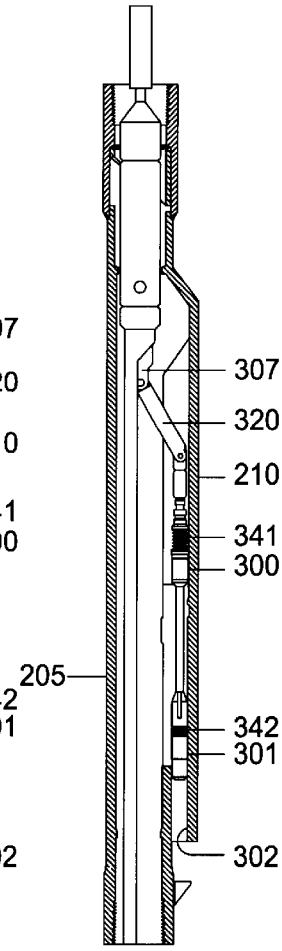
Figure 7C:
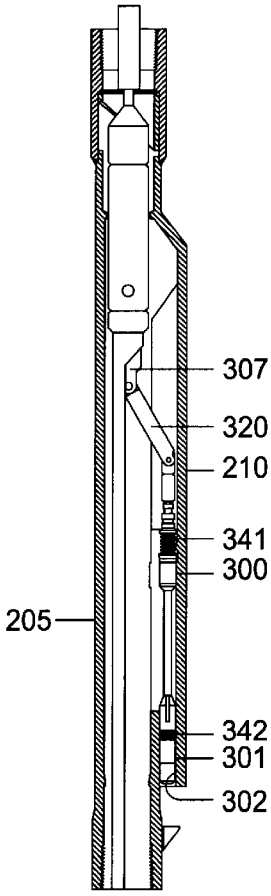
Figure 7D:
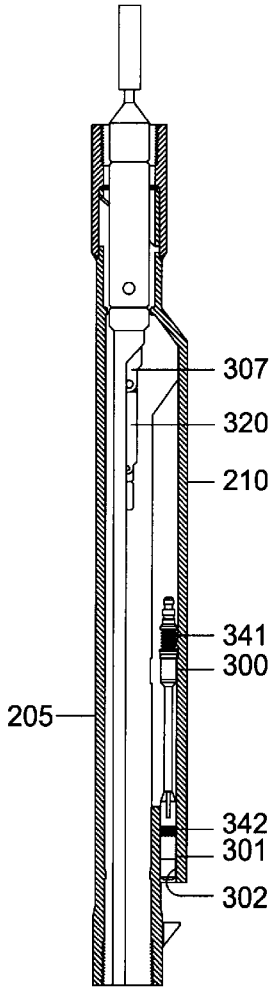

FIGS. 7A–7D illustrate a method and apparatus for remotely disposing a nozzle assembly in a pocket formed in a side of a tubular body. The method is particularly valuable when formation conditions change and it becomes desirable to decrease or increase the amount of steam injected into a particular zone. With the apparatus described and shown, a nozzle with different characteristics can be placed in the wellbore with minimal disruption to operation. FIG. 7A is a section view illustrating a section of tubing 205 with a pocket 210 formed on a side thereof. Locatable in the pocket is a nozzle assembly 300 which includes a nozzle 301 which is sealingly disposable in an aperture 302 formed between an outer wall of the tubular and the inner wall of the pocket 210. The nozzle has the same throat and diffuser portions as previously described in relation to FIG. 4. At an upper end of the nozzle assembly is a latch 341 for connection to a "kick over" tool 307 which is constructed and arranged to urge the nozzle assembly 300 laterally and to facilitate its insertion into the pocket. The kick over tool includes a means for attachment to the nozzle assembly 300 as well as a pivotal arm 320 which is used to extend the nozzle assembly 300 out from the centerline of the tubular 205 and into alignment with the pocket 210. In FIG. 7A, the nozzle assembly 300 is shown in a run in position and is axially aligned with the centerline of the tubular 205. In FIG. 7B, the kick over tool 307 has been actuated, typically by upward movement from the surface of the well, and has been aligned with and extended into axial alignment with the pocket 210. In FIG. 7C, downward movement of the nozzle assembly 300 has located the nozzle 301 in a sealed relationship (seal 342) with a seat 302 formed at a lower end of the pocket 210. In FIG. 7D, a shearable connection between the nozzle assembly 300 and the kick over tool 307 has been caused to fail and the kick over tool 307 can be removed from the wellbore, leaving the nozzle assembly 300 installed in the pocket 210.

In addition to installing and removing a modular nozzle, the embodiment of FIGS. 7A–7D also provide a remotely installable and removable sleeve having apertures in a wall thereof. In this manner, the nozzle can be installed in the pocket without interference. In one aspect, the sleeve is removed from the apparatus in a separate trip before the nozzle is removed. In another aspect, the sleeve is returned to the apparatus and installed after the nozzle has been installed.

Figure 8:
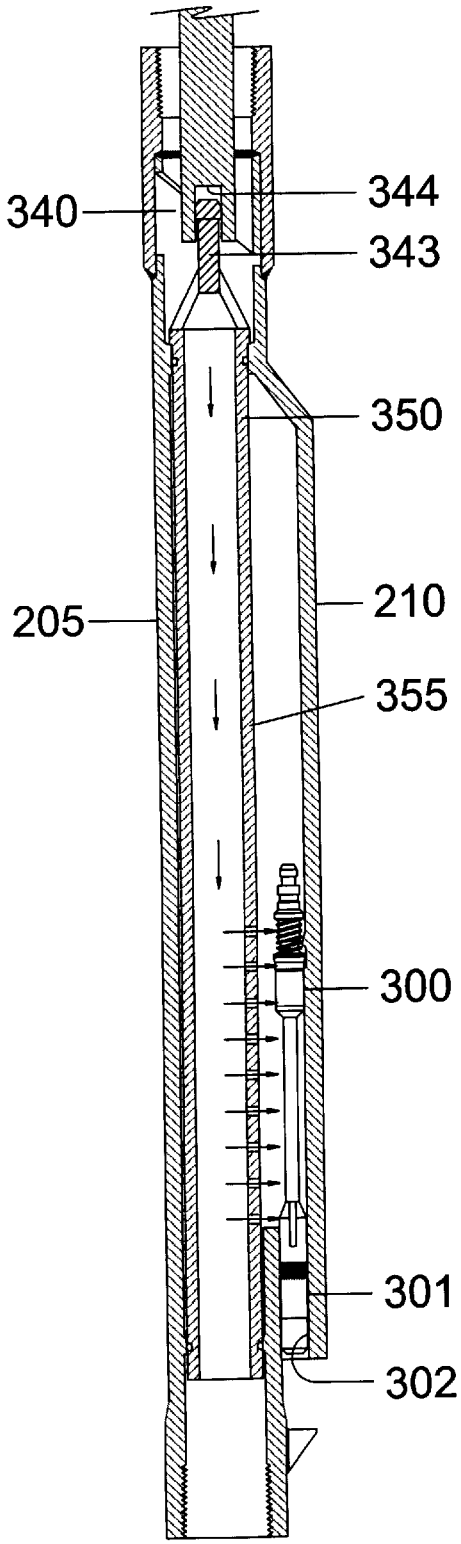
FIG. 8 is a section view showing a removable sleeve with apertures.

FIG. 8 illustrates a removable sleeve 350 in the tubing 205 between the interior of the tubing and the nozzle assembly 300. The sleeve includes apertures 355 formed in a wall thereof to control the proportionate flow of steam components as described previously. Also visible is a run in tool 340 used to install and remove the sleeve and a pin and slot arrangement 343, 344 permitting the sleeve to be placed and then left in the apparatus. Typically, the removable sleeve 350 is inserted adjacent the pocket 210 after the removable nozzle assembly 300 has been installed. Conversely, the sleeve 350 is removed prior to the removal of the nozzle assembly 300.

It will be understood that while the methods and apparatus of FIGS. 7A–7D and 8 have been discussed as they would pertain to installing a nozzle, the same methods and apparatus are equally usable removing a nozzle assembly from a pocket formed on the outer surface of a tubular and the invention is not limited to either inserting or removing a nozzle assembly.

In addition to providing a controlled flow of steam to multiple zones in a single wellbore, the nozzle of the present invention can be utilized at the surface of the well to provide a controlled flow of steam from a single steam source to multiple wellbores. In one example, a steam conduit from a source is supplied and a critical flow-type nozzle is provided between the steam source and each separate wellbore. In this manner, a controlled critical flow of steam is insured to each wellbore without interference from pressure on the wellbore side of the nozzle.

In addition to providing a means to insure a controlled flow of steam into different zones in a single wellbore, the apparatus described therein provides a means to prevent introduction of steam into a particular zone if that becomes necessary during operation of the well. For instance, at any time, a portion of tubing including a pocket portion can be removed and replaced with a solid length of tubing containing no apertures or nozzles for introduction of steam into a particular zone. Additionally, in the embodiment providing removable nozzles and removable sleeves, a sleeve can be provided without any apertures in its wall and along with additional sealing means, can prevent any steam from traveling from the main tubing string into a particular zone. Alternatively, a blocking means can be provided that is the same as a nozzle in its exterior but lacks an internal flow channel for passage of steam.

In order to install a particular sleeve adjacent a particular pocket, the sleeves may be an ever decreasing diameter whereby the smallest diameter sleeve is insertable only at the lower most zone. In this manner, a sleeve having apertures designed for use with in a particular zone cannot be inadvertently placed adjacent the wrong zone. In another embodiment, the removable sleeves can use a keying mechanism whereby each sleeve's key will fit a matching mechanism of any one particular zone. In one example, the keys are designed to latch only in an upwards direction. In this manner, sleeves are installed by lowering them to a position in the wellbore below the intended zone. Thereafter, as the sleeve is raised in the wellbore, it becomes locked in the appropriate location. These types of keying methods and apparatus are well known to those skilled in the art.

While the foregoing is directed to embodiments of the present invention, other and further embodiments of the invention may be devised without departing from the basic scope thereof, and the scope thereof is determined by the claims that follow.

We claim:

1. An apparatus for injecting steam from a wellbore into a geological formation, the apparatus comprising:

a flow path between a well surface and the formation, the flow path including a string of tubulars having at least two apertures formed along the string of tubulars proximate the formation, wherein the at least two apertures are constructed and arranged to permit steam to pass therethrough while maintaining a predetermined ratio of water and vapor, the flow path further including at least one nozzle, the at least one nozzle including a throat portion and a diffuser portion, whereby the steam will flow through the nozzle at a critical flow rate.

2. The apparatus of claim 1, wherein the critical flow rate is a controlled flow rate.

3. The apparatus of claim 2, wherein the string of tubulars extends from the well surface to the formation and the at least one nozzle is located in the string of tubulars, proximate the formation.

4. The apparatus of claim 3, wherein the flow path further includes a fluid path formed in a wall of a casing lining the wellbore, the fluid path formed adjacent the formation.

5. The apparatus of claim 4, wherein the fluid path formed in the casing includes perforations.

6. The apparatus of claim 3, further including at least one opening formed along the string of tubulars proximate the formation, the at least one nozzle connected to the at least one opening.

7. The apparatus of claim 6, wherein the at least one opening includes an enlarged area or a pocket.

8. The apparatus of claim 7, further including a wall between an interior of the tubing and the at least one opening, the wall having the at least two apertures formed therein.

9. The apparatus of claim 8, wherein the number of apertures in the wall between the tubing and the pocket is variable and selectable.

10. The apparatus of claim 9, further including an intermediate sleeve member disposable in the tubular string adjacent the apertures in the wall, the intermediate sleeve member having apertures alignable with the apertures in the wall.

11. The apparatus of claim 10, wherein the steam is saturated steam.

12. The apparatus of claim 11, wherein the steam includes a component of water and a component of vapor.

13. The apparatus of claim 7, wherein there are at least two pockets disposed along the tubular string and an annular area between each pocket and an adjacent formation is isolated with a packing member.

14. The apparatus of claim 13, wherein the nozzle is remotely removable.

15. The apparatus of claim 14, wherein the nozzle is remotely insertable.

16. The apparatus of claim 10, wherein the apertures in the sleeve are constructed and arranged to permit steam to pass from the tubing to the pocket while maintaining the predetermined ratio of water and vapor.

17. The apparatus of claim 16, wherein the apertures in the wall between the tubing and the pocket are substantially perpendicular to a longitudinal axis of the tubing.

18. The apparatus of claim 17, wherein the flow of fluid through the nozzle is approximately parallel to the longitudinal axis of the tubing.

19. An apparatus for injecting steam at a controlled flow rate into a geological formation, the apparatus comprising:

a flow path between a well surface and the formation, the flow path including at least one nozzle, the nozzle variable to convert the steam to a critical flow rate at an annulus/tubing pressure ratio greater than about 0.56.

20. A method of injecting steam into a geological formation comprising:

introducing the steam into a wellbore lined with casing, the wellbore including at least one zone of interest and the casing having perforations adjacent the at least one zone;

maintaining a predetermined ratio of water and vapor by permitting the steam to pass through at least two apertures formed along a string of tubing; and flowing the steam through a nozzle at a critical flow rate from the string of tubing to the perforations, the nozzle having a throat portion and a diffuser portion.

21. The method of claim 20, wherein the critical flow rate is maintained when an annulus/tubing ratio is greater than about 0.56.

22. The method of claim 21, wherein the steam is introduced at a pressure adequate to overcome a natural pressure and impermeability present in any of the at least one zone of interest.

23. The method of claim 22, further including causing a flow of the steam through the tubing whereby a water component of the steam travels in an annular fashion along an inner wall of the tubing.

24. The method of claim 23, further including removing the nozzle and replacing it with a second nozzle.

25. An apparatus for injecting steam at a controlled rate into multiple zones of interest adjacent a wellbore, the apparatus comprising:

a tubular string for transporting steam into the wellbore from the surface of the well;

at least two apertures formed alone the tubular string proximate the multiple zones of interest, the at least two apertures are constructed and arranged to permit steam to pass therethrough while maintaining a predetermined ratio of water and vapor; and at least two nozzles disposed along the string, each nozzle located in that position of the wellbore adjacent a first and second zone of interest, the nozzles having a throat portion and a diffuser portion.

26. The apparatus of claim 25, further including sealing means isolating an annular area above and below each nozzle, the annular area formed between the tubular and walls of the wellbore.

27. An apparatus for injecting steam into multiple wellbores from a single source of steam, the apparatus comprising:

a fluid path from the source of steam to each wellbore, the fluid path includes a string of tubulars having at least two apertures formed along the string of tubulars proximate a zone of interest, wherein the at least two apertures are constructed and arranged to permit steam to pass therethrough while maintaining a predetermined ratio of water and vapor; and at least one nozzle between the source and each wellbore, the at least one nozzle including a throat and a diffuser portion providing a predetermined flow rate of steam to each wellbore.

28. An apparatus for injecting steam from a source of steam to at least two wellbores, the apparatus comprising:

a flow path for the steam between the source of steam and the at least two wellbores the flow oath includes a string of tubulars having at least two apertures formed along the string of tubulars proximate a zone of interest, wherein the at least two apertures are constructed and arranged to permit steam to pass therethrough while maintaining a predetermined ratio of water and vapor; and at least one nozzle in the flow path, the nozzle for controlling a flow of steam using critical flow.

29. The apparatus of claim 28, wherein there are an equal number of nozzles and wellbores.

30. The apparatus of claim 28, wherein the at least one nozzle includes a throat portion and a diffuser portion.

31. An apparatus for injecting steam from a wellbore into a geological formation, the apparatus comprising:

a flow path between a well surface and the formation, the flow path including at least one nozzle, the at least one nozzle including a throat portion and a diffuser portion, whereby the steam will flow through the nozzle at a critical flow rate which is a controlled flow rate, wherein the flow path includes a string of tubulars extending from the well surface to the formation and the at least one nozzle located in the string of tubulars, proximate the formation and a fluid path formed in a wall of a casing lining the wellbore, the fluid path formed adjacent the formation;

at least one opening formed along the string of tubulars proximate the formation, the at least one nozzle connected to the at least one opening which includes an enlarged area or a pocket;

a wall between an interior of the tubing and the at least one opening, the wall having at least one aperture formed therein, wherein the number of apertures in the wall between the tubing and the pocket is variable and selectable.

32. The apparatus of claim 31, further including an intermediate sleeve member disposable in the tubular string adjacent the apertures in the wall, the intermediate sleeve member having apertures alignable with the apertures in the wall.

33. The apparatus of claim 32, wherein the apertures in the sleeve are constructed and arranged to permit steam to pass from the tubing to the pocket while maintaining the predetermined ratio of water and vapor.

* * * * *

UNITED STATES PATENT AND TRADEMARK OFFICE

CERTIFICATE OF CORRECTION

PATENT NO. : 6,708,763 B2
DATED : March 23, 2004
INVENTOR(S) : Howard et al.

It is certified that error appears in the above-identified patent and that said Letters Patent is hereby corrected as shown below:

Column 9,
Line 43, please change “oath” to -- path --.

Signed and Sealed this

Tenth Day of August, 2004

JON W. DUDAS
*Acting Director of the United States Patent and Trademark Office*